US007048512B2

(12) United States Patent
Couillard et al.

(10) Patent No.: US 7,048,512 B2
(45) Date of Patent: May 23, 2006

(54) METHOD AND SYSTEM INTENDED FOR FINE PROPORTIONING OF FLUIDS INJECTED INTO A PUMPING INSTALLATION WITH CHECK VALVE PROPORTIONING COMPENSATION

(75) Inventors: François Couillard, 1 rue du Beg Du, 56860 Sene (FR); Daniel Durand, Rueil Malmaison (FR)

(73) Assignees: Institut Francais du Petrole, Rueil-Malmaison Cedex (FR); Francois Couillard, Yerre (FR)

( * ) Notice: Subject to any disclaimer, the term of this patent is extended or adjusted under 35 U.S.C. 154(b) by 235 days.

(21) Appl. No.: 10/369,719

(22) Filed: Feb. 21, 2003

(65) Prior Publication Data

US 2003/0156952 A1 Aug. 21, 2003

(30) Foreign Application Priority Data

Feb. 21, 2002 (FR) ..... 02 02243

(51) Int. Cl.
*B67D 5/60* (2006.01)
*F04B 9/00* (2006.01)

(52) U.S. Cl. ..... 417/53; 417/298; 222/132; 222/145.7

(58) Field of Classification Search ..... 417/295, 417/288, 298, 297, 503, 505, 563, 442, 53; 137/266, 607, 606; 222/52, 63, 136, 144.5, 222/145.7, 132
See application file for complete search history.

(56) References Cited

U.S. PATENT DOCUMENTS 4,310,420 A * 1/1982 Konishi et al. ..... 210/659
4,437,812 A * 3/1984 Abu-Shumays et al. ..... 417/53
4,595,495 A * 6/1986 Yotam et al. ..... 210/101
4,595,496 A 6/1986 Carson
4,643,649 A * 2/1987 Schmid ..... 417/45
4,797,834 A * 1/1989 Honganen et al. ..... 700/285
5,755,561 A * 5/1998 Couillard et al. ..... 417/246
6,116,869 A 9/2000 Couillard et al.

FOREIGN PATENT DOCUMENTS

| | | |
|---|---|---|
| DE | 2821005 | 11/1978 |
| EP | 0 040 161 | 11/1981 |
| EP | 0 194 450 | 9/1986 |
| EP | 0 309 596 | 3/1993 |
| EP | 0 709 572 B1 | 5/1996 |
| FR | 2 768 189 | 3/1999 |

* cited by examiner

*Primary Examiner*—Charles G. Freay
(74) *Attorney, Agent, or Firm*—Antonelli, Terry, Stout and Kraus, LLP.

(57) ABSTRACT

A method and system is intended for fine proportioning of fluids injected into a pumping installation, e.g., a liquid chromatography installation, allowing to compensate for non-return valve errors. The system includes a fluid delivery system including vessels for constituents (A, B, X) that communicate with a pumping unit (1–11) by means of a one-way valve (8) that opens upon suction, and a control unit (PC) that adjusts the respective proportions of the various fluids sucked by acting on the opening time of solenoid valves (EV1 to Even) associated with the various vessels. As the opening and closing times of the one-way valve are most often unequal in practice, control unit (PC) is suited to cyclically change the order of the control signals applied to the various solenoid valves during the various successive suction stages of each pumping unit so as to compensate on average for the proportioning inequalities due to each one-way valve.

8 Claims, 3 Drawing Sheets

METHOD AND SYSTEM INTENDED FOR FINE PROPORTIONING OF FLUIDS INJECTED INTO A PUMPING INSTALLATION WITH CHECK VALVE PROPORTIONING COMPENSATION

FIELD OF THE INVENTION

The present invention relates to a method and to a system intended for fine proportioning of fluids injected into a pumping installation.

The proportioning system according to the invention can be used notably for injection of a mixture of fluids into liquid chromatography installations, with very accurate proportioning of the mixture components.

Liquid chromatography installations generally comprise one or more pumps. They draw a <<mobile phase>> consisting of solvents or mixtures of solvents out of one or more vessels and feed them into a separation column filled with a powdered material referred to as <<stationary phase>> on which a liquid mixture or sample whose constituants are to be separated (analytical chromatography) or at least one constituent of which is to be removed for purification (preparative chromatography) is passed. The flow rates involved can range, as the case may be, from some microliters/minute to several ten liters/minute. The pressures prevailing therein can range from 0.1 MPa to several ten MPa. Inside the column, a competition develops for the sample between the stationary phase and the mobile phase. The components of the sample are more or less retained by the stationary phase according to their molecular structures (the extent of the phenomenon being characterized by a time referred to as retention time) and to the chromatography conditions: type of stationary and mobile phase used, flow rate, etc.

A suitable detector indicates the passage of the eluates coming from the column. In analytical chromatography, the indications supplied by the detector provide a quantitative result through measurement of the areas of the signal peaks detected, and a qualitative result through measurement of the retention times. In preparative chromatography, the data provided by the detector qualitatively indicate to an operator the right time to open the collection valves in order to recover the desired eluates by means of the collector.

The working principle defined above relates to a chromatograph working in <<isochratic>> mode. It corresponds to the case where the composition of the mobile phase is constant throughout the separation. Another operating mode, referred to as <<elution gradient>> mode, corresponds to the more complex cases where it is necessary to vary the composition of the mobile phase during separation to obtain the desired result.

Either pumping systems referred to as <<low pressure>> or <<upstream gradient>> systems, or pumping systems referred to as <<high pressure>> or <<downstream gradient>> systems are used for liquid chromatography operations.

The pumps used generally comprise one or more pistons alternately displaced in pump barrels by motive means. The pistons can be in contact with rotating cams. The profile of the came, their eccentricity and/or their driving speed are used to vary the flow rate of the liquids pumped. The pistons can also be in contact with nuts by means of balls, and these nuts are alternately displaced by means of endless screws. One or more direct-current or stepping motors controlled by a microcomputer drive them into rotation.

BACKGROUND OF THE INVENTION

The prior art is illustrated for example by patents EP-40,161, EP-194,450 or EP-309,596, which describe pumps for applications to liquid chromatography, and embodiments wherein a pump can be associated with a system of solenoid valves to obtain elution gradients with several solvents.

Patent EP-0,709,572 (U.S. Pat. No. 5,755,561) filed by the applicants also describes a pumping system comprising one or more pumping modules connected by one-way valves respectively to vessels containing fluids to be mixed, a collection head receiving the fluids delivered by the various primary modules, and a secondary pumping unit with a piston for discharging at a substantially constant rate the mixture of fluids collected in this head. The pistons are alternately displaced either through rotation of the cams or through translation of the endless screws. A control unit associated with position detectors and pressure detectors proportions the fluids injected and adjusts the phases, the piston strokes and their speed so as to obtain a substantially constant discharge rate. Each primary module can also comprise a second pumping module allowing to obtain also a constant suction rate.

Patent FR-2,768,189 (U.S. Pat. No. 6,116,869) also filed by the applicants describes another pumping system allowing to obtain a mixture of liquids with well-adjusted proportions and flow rates. It comprises a liquid mixing device located upstream from a pump. The liquids are taken from vessels and cyclically fed, in predetermined proportions, into a mixing chamber by alternate opening of solenoid valves working under on-off conditions. The suction phase of the system is controlled by using damping means such as bellows in antechambers so as to avoid the effects of velocity discontinuities when the valves open and close. The flow rate of the pump is controlled upon suction as well as upon discharge.

An example of a reciprocating pumping unit that can be used is diagrammatically shown in FIGS. 1, 2. It comprises a pump barrel 1 provided with a cylindrical inner cavity 2. Through an opening in the bottom of the barrel, a rod 3 partially fits into inner cavity 2. Sealing means 4 arranged around the rod insulate the inner cavity. Rod 3 is provided with a head 5. A spring 6 is arranged between it and the end of the barrel so as to exert a permanent extraction force on the piston.

At the opposite end thereof, inner cavity 2 communicates with a line 7 provided with a one-way valve 8 (such as a ball check valve) which opens during the suction phase as rod 3 moves back. A pressure detector C is arranged for example in line 7 downstream from valve 8.

According to a first embodiment (FIG. 1), the more or less great depth of penetration of rod 3 in inner cavity 2 is provided by the rotation of a cam 9 resting against head 5, whose shaft 10 is driven in rotation by a motor 11. The more or less great depth of penetration of rod 3 in cylindrical cavity 2 is obtained by changing the eccentricity d of the cam on the shaft.

According to a second embodiment (FIG. 2), the more or less great depth of penetration of rod 3 in inner cavity 2 is obtained by the translation of an endless screw 12 resting on head 5 by means of a ball thrust 13. The screw translation means include for example a nut 14 suited to screw 12, which is for example housed in the hollow rotor of a stationary electric motor 15 which drives it into rotation. The direction of translation of the screw is changed by inverting the direction of rotation of the motor every pumping half cycle. Motors 11 or 15 can be, for example, direct-current or stepping type motors.

Line 7 upstream from non-return valve 8 is connected by means of solenoid valves EV1, EV2, EVn respectively to vessels containing the fluid components A, B, . . . , X to be mixed. An associated control unit PC adjusts the opening of the solenoid valves while observing predetermined ratios between their respective opening times according to the desired concentration ratios between the solvents injected.

Experience shows that this proportioning mode is very imprecise. The real proportion of the constituents in the mixture sucked is far from corresponding to the proportion that would be expected when relying on the respective opening times of the solenoid valves.

After studying this problem, it has been noticed that the non-return valves were the main cause of this imprecision because, in practice, their opening and closing times are different. If the opening order of the solenoid valves during a suction phase is of the order EV1, EV2, . . . , EVn, for example, the effective proportions of the first constituent injected A and of the last constituent injected X are differently affected by the unequal opening and closing times of ball check valve 8.

SUMMARY OF THE INVENTION

The method according to the invention allows to form a precisely proportioned mixture from various fluid constituents contained in vessels, by means of at least one reciprocating pumping unit with each a suction phase and a discharge phase, whose inlet is connected to the various vessels by means of a one-way valve and of solenoid valves whose respective opening times during the suction phase are selected so as to obtain a mixture with given proportions. It is characterized in that the order of succession of the respective opening times of the solenoid valves is cyclically changed during the successive suction phases so as to compensate on average for the proportioning inequalities due to the opening and closing time inequalities of each one-way valve.

According to a first embodiment, each solenoid valve is opened only once during each successive suction phase.

According to another embodiment, each solenoid valve is opened several times during each successive suction phase, while observing the suitable cyclic ratio between the opening times of the solenoid valves so as to obtain predetermined proportions.

Each suction phase preferably comprises a whole number of time intervals. It can however comprise a non-whole number of time intervals, and an interval started during one suction cycle can end during one of the next cycles.

The system according to the invention allows to form a precisely proportioned mixture from various fluid constituents. It is characterized in that it comprises a fluid delivery system including vessels for constituents which communicate with a pumping unit by means of a one-way valve that opens upon suction, and a control unit that adjusts the respective proportions of the various fluids sucked by acting on the opening times of solenoid valves associated with the various vessels. It is characterized in that the control unit is suited to cyclically change the order of the control signals applied to the various solenoid valves during the various successive suction phases of each pumping unit so as to compensate on average for the proportioning inequalities due to each one-way valve.

The control unit is for example suited to control only once opening of each solenoid valve during each successive suction phase.

According to another embodiment, the control unit is suited to control opening of each solenoid valve several times during each successive suction phase, while observing the suitable cyclic ratio between the opening times of the solenoid valves so as to obtain predetermined proportions.

According to an embodiment, control unit (PC) is suited to distribute a whole number of time intervals in each suction phase.

According to another embodiment, control unit (PC) is suited to distribute a non-whole number of time intervals in each suction phase, and an interval started during one suction phase can end during one of the next stages.

According to another embodiment, the suction unit communicates by means of a second one-way valve with a secondary unit suitably phase-shifted in relation to the first suction unit.

The control unit preferably applies respectively to the suction unit and to the secondary unit motion laws so selected that the sum of their derivatives is permanently constant, so as to obtain a pump with a really constant discharge rate.

This rotation of the opening order of the various solenoid valves of the suction unit providing on average excellent compensation for the working inequalities of the non-return valves, the effective proportion of each constituent of the mixture corresponds to the desired proportion imposed by the control computer.

BRIEF DESCRIPTION OF THE DRAWINGS

Other features and advantages of the method and of the system according to the invention will be clear from reading the description hereafter of an embodiment given by way of non limitative example, with reference to the accompanying drawings wherein.

DETAILED DESCRIPTION

Figure 1:
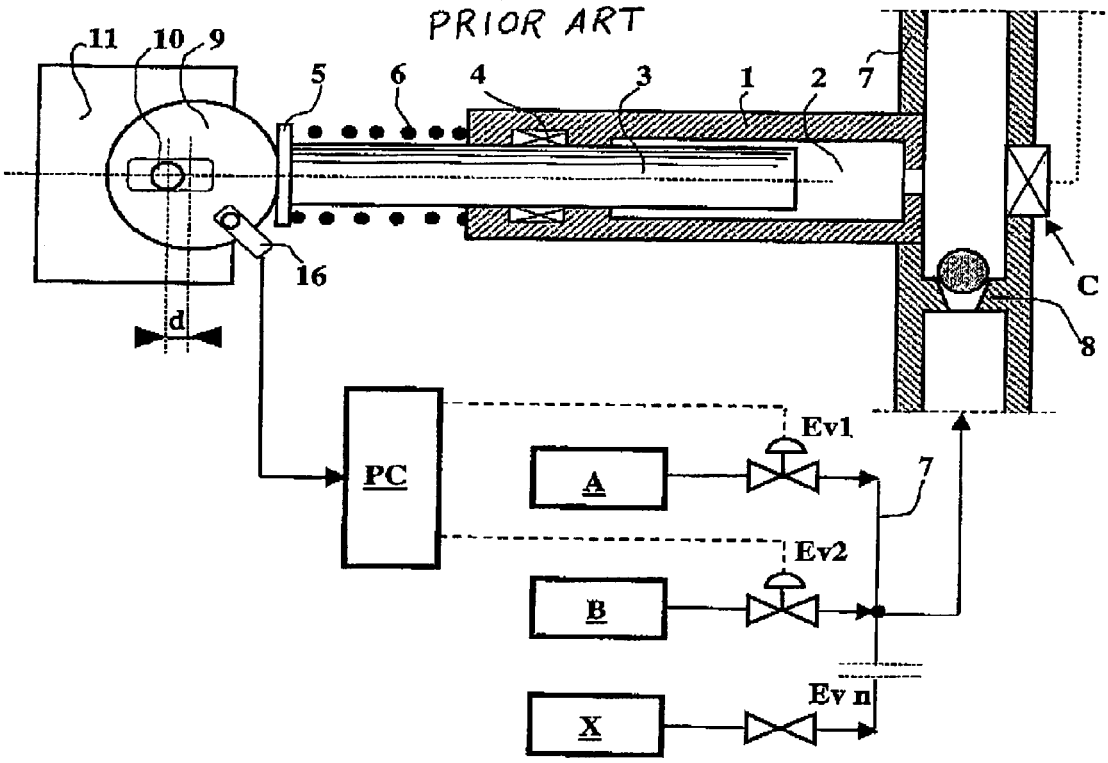
FIG.1 PRIOR ART
FIG. 1 diagrammatically shows an example of a pumping system with a single pumping unit comprising a reciprocating piston driven by the rotation of a cam, FIG. 2 diagrammatically shows a reciprocating driving mode of the piston of the pumping unit using a screw-nut assembly, FIG. 3 diagrammatically shows how the displacement amplitude and phase of the piston of the pumping unit of FIG. 1 vary during a pumping cycle, FIG. 4(*c*1 to *c*4) shows, in the case of a mixture consisting of only two constituents A, B, a first embodiment where the order of succession of the opening times of the solenoid valves during each suction phase is alternated from one suction phase to the next, while observing the same cyclic ratio between the times so as to meet predetermined proportions, FIG. 5(*c*1 to *c*3) shows, in the same case, a second embodiment where the order of succession of the opening times of the solenoid valves during each suction phase is alternated from one suction phase to the next, while similarly observing the same cyclic ratio between the times so as to meet predetermined proportions.

The rotation of the cam as shown in FIG. 1 causes piston 3 to follow a reciprocating motion with a suction phase where, non-return valve 8 being open, the constituents of the mixture to be pumped are allowed into chamber 2 as piston 3 moves back in cylinder 1, and a discharge phase where, valve 8 being back on its seat, the piston moves into cylinder 1 and expels the volume of the mixture. The computer knows, by previous calibration, the volume displaced by the piston in chamber 2, for each angular rotation increment of cam 9 all around it. A detector 16 (an optical detector for example) is associated with motive means 9, 11 to detect the passage of cam 9 through the position corresponding for example to the very beginning of the recoil phase of piston 3 in cylinder 1 (suction start). Upon reception of the signal delivered by detector 16, computer PC adjusts the opening times $t_1$ to $t_n$, of the various solenoid valves EV1 to EVn so as to obtain a predetermined proportioning of the various constituents of the mixture.

Figure 2:
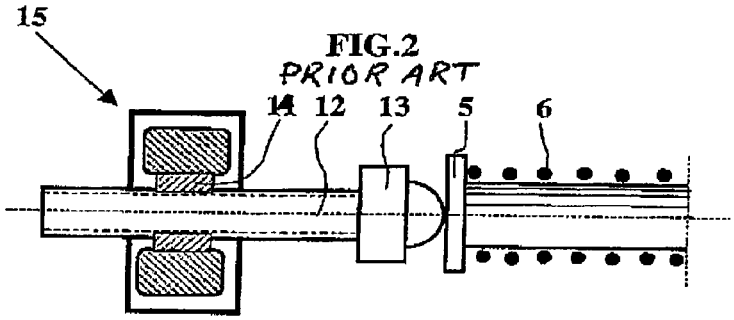
FIG.2 PRIOR ART
Figure 3:
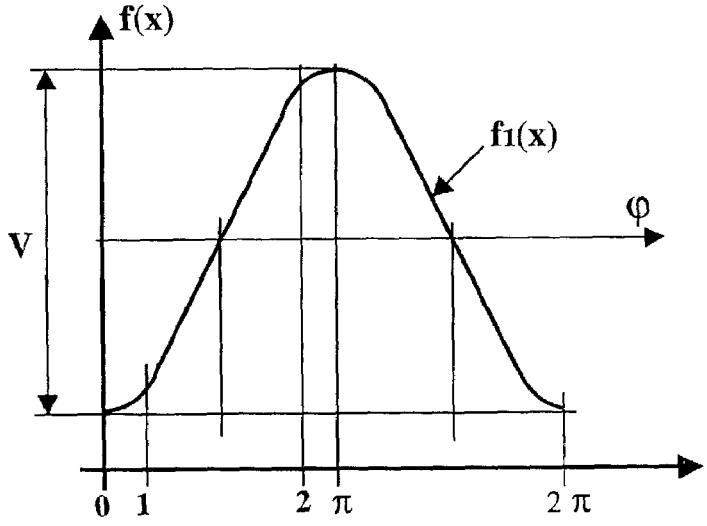

It can be noted that, in the control mode of FIG. 2 where the piston is displaced by rotation of an endless screw, the computer similarly knows the volume displaced by the piston every time the screw completes a turn or a portion of a turn, and it can adjust opening times $t_1$ to $t_n$ accordingly.

The respective opening To and closing Tc times of each non-return valve 8 are most often unequal in practice. If an unchanging alternation is selected, as shown for example in FIG. 4-*c*1, the injection interval of constituent A starts with the opening of the valve and that of constituent B always ends with the closing of the valve at the end of the suction phase. Because of the valve opening and closing time inequalities, the volumes of the two constituents actually sucked are affected differently and the effective proportions will be different from those initially expected.

Figure 4:
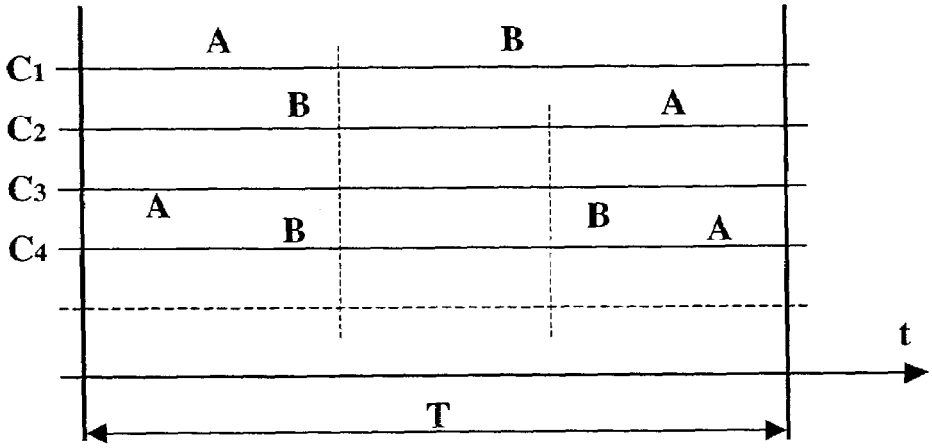

That is the reason why the initial order of succession of the opening intervals is alternated from one suction phase to the next, and succession A-B is replaced during the next cycle, FIG. 4-*c*2, by succession B-A, and so on A-B, B-A, etc. (FIG. 4-*c*3, 4-*c*4) for the next phases.

Figure 5:
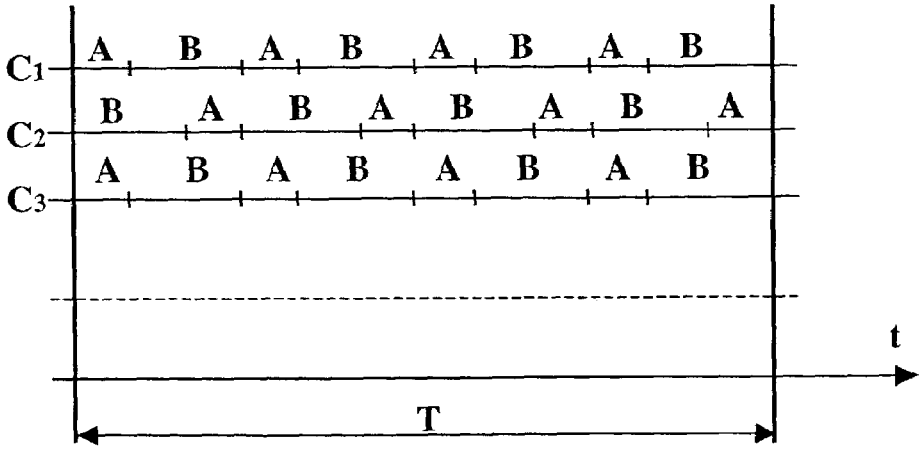

In the embodiment illustrated in FIG. 5, the same procedure is substantially followed but, instead of having a single series of opening intervals A-B during a suction phase of duration T, several series are inserted successively and in the same order. Series A-B-A-B-A-B-A-B will thus take place during phase 5-*c*1. In order to obtain the same proportioning control effect in the next suction phase, succession B-A-B-A-B-A-B-A (FIG. 5-*c*2) is selected so as to have a cyclic alternation of intervals A and B that coincide with the opening and the closing of valve 8 (FIG. 5-*c*3).

The simple case where each suction cycle contains a whole number of alternations A-B or B-A has been considered so far. It is clear that it is also possible to include in each suction cycle a non-whole number of alternations A-B and B-A. In such a case, computer PC can be readily programmed to adjust the duration of the intervals that coincide with the opening and the closing of valve 8 so that, on average, the proportion in the mixture of each fluid injected also corresponds to the expected proportion.

In any case, the sequence to be applied-depends of course on the flow rate of the mixture sucked and discharged.

For the sake of simplicity, the case where only two constituents A and B are alternately sucked by the pump during each suction phase has been described. It is however clear that the same procedure would be followed with any number n of components. In such a case, the order of succession of the time intervals just has to be so selected that, for each phase of a series of n successive phases, a different component is the first to be injected when valve 8 opens and the last to be injected when the valve closes, so as to compensate on average for the inequalities due thereto.

Figure 6:
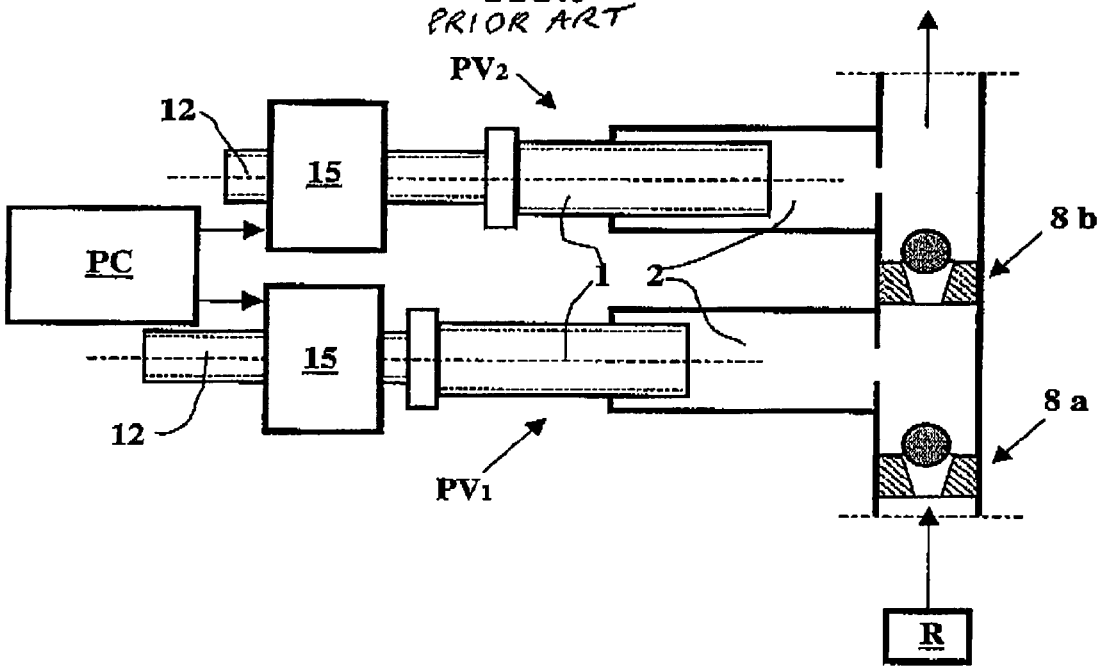
FIG.6 PRIOR ART
FIG. 6 shows an example of combination of a suction unit (PV1) with a discharge unit (PV2).

As already described in the aforementioned patent EP-0, 709,572, suction unit PV1 of FIGS. 1, 2 can communicate (FIG. 6) by means of a second non-return valve 8*b* with a secondary unit PV2 suitably phase-shifted in relation to the first unit. The motion laws f(x) and g(x) of the pistons of the two pumping units are for example so selected that the sum of their derivatives f'(x)+g'(x) is permanently constant, so as to obtain a pump with a really constant discharge rate.

The invention claimed is:

1. A method for forming a precisely proportioned mixture from various fluid constituents (A, B, . . . , X) contained in vessels, applied to at least one reciprocating pumping unit with each a suction phase and a discharge phase, whose inlet is connected to the various vessels by one-way valve and solenoid valves whose respective opening time intervals (t1 to tn) during the suction phase are selected so as to obtain a mixture with given proportions, comprising:

cyclically changing the order of succession of the respective opening time intervals of the solenoid valves from one suction phase to the next so as to compensate on average for the proportioning inequalities due to the opening and closing time inequalities of each one-way valve.

2. A method as claimed in claim 1, characterized in that each solenoid valve is opened only once during each successive suction phase.

3. A method as claimed in claim 1, characterized in that each solenoid valve is opened several times during each successive suction phase while observing the suitable cyclic ratio between the opening times of the solenoid valves so as to obtain predetermined proportions.

4. A method as claimed in claim 3, characterized in that each suction phase comprises a whole number of time intervals.

5. A method as claimed in claim 3, characterized in that each suction phase comprises a non-whole number of time intervals, and an interval started during one suction cycle can end during one of the next cycles.

6. A method as claimed in claim 1, characterized in that a constant cyclic ratio between opening times of the solenoid values is maintained for each suction phrase.

7. A method as claimed in claim 1, characterized in that the method is applied to a first pumping unit and a second pumping unit.

8. A method as claimed in claim 7, characterized in that motion laws f(x) and g(x) so selected that the sum of their derivatives f'(x)+g'(x) is permanently constant are respectively applied, by the control unit, to the first pumping unit and to the second pumping unit.

* * * * *